US010020583B2

(12) United States Patent
Wu et al.

(10) Patent No.: US 10,020,583 B2
(45) Date of Patent: Jul. 10, 2018

(54) ANTENNA DEVICE

(71) Applicant: Arcadyan Technology Corporation, Hsinchu (TW)

(72) Inventors: Min-Chi Wu, Zhubei (TW); Kuo-Chang Lo, Toufen Township (TW)

(73) Assignee: Arcadyan Technology Corporation, Hsinchu (TW)

( * ) Notice: Subject to any disclaimer, the term of this patent is extended or adjusted under 35 U.S.C. 154(b) by 24 days.

(21) Appl. No.: 15/433,321

(22) Filed: Feb. 15, 2017

(65) Prior Publication Data

US 2017/0317419 A1 Nov. 2, 2017

(30) Foreign Application Priority Data

Apr. 28, 2016 (TW) ..... 105113278 A

(51) Int. Cl.

| | |
|---|---|
| ***H01Q 1/24*** | (2006.01) |
| ***H01Q 9/04*** | (2006.01) |
| ***H01Q 5/30*** | (2015.01) |
| ***H01Q 1/48*** | (2006.01) |

(52) U.S. Cl.

CPC ..... *H01Q 9/0421* (2013.01); *H01Q 1/48* (2013.01); *H01Q 5/30* (2015.01)

(58) Field of Classification Search

CPC ..... H01Q 9/0421; H01Q 5/30; H01Q 1/38; H01Q 1/243

See application file for complete search history.

(56) References Cited

U.S. PATENT DOCUMENTS

| | | | | |
|---|---|---|---|---|
| 8,085,202 | B2 | 12/2011 | Ayatollahi et al. | |
| 8,937,578 | B2 | 1/2015 | Montgomery | |
| 2011/0298669 | A1* | 12/2011 | Rao | H01Q 1/243 343/702 |
| 2012/0274532 | A1* | 11/2012 | Kurashima | H01Q 1/243 343/833 |
| 2013/0314297 | A1* | 11/2013 | Hamabe | H01Q 21/28 343/893 |

FOREIGN PATENT DOCUMENTS

CN 102570010 B 9/2014

* cited by examiner

*Primary Examiner* — Dieu H Duong
(74) *Attorney, Agent, or Firm* — Innovation Counsel LLP

(57) ABSTRACT

A dual-band antenna includes a substrate, a first antenna assembly, an isolation metal sheet, and a second antenna assembly. The first antenna assembly includes a first and a second planar inverted-F antennas, which are symmetric with each other and disposed on the first side of the substrate. The first planar inverted-F antenna includes a first radiation portion and a first ground portion. The second planar inverted-F antenna includes a second radiation portion and a second ground portion. The isolation metal sheet is coupled between the first ground portion and the second ground portion. The second antenna assembly includes a third and a fourth antennas, which are coupled to the first and the second ground portions, respectively, and are symmetric with each other and are disposed on the second side of the substrate. The first and the second antenna assemblies are operated at a first and a second frequencies, respectively.

8 Claims, 11 Drawing Sheets

ANTENNA DEVICE

This application claims the benefit of Taiwan application Serial No. 105113278, filed Apr. 28, 2016, the subject matter of which is incorporated herein by reference.

BACKGROUND OF THE INVENTION

Field of the Invention

The invention relates in general to an antenna device, and more particularly to a dual-band antenna.

Description of the Related Art

Portable electronic devices (such as mobile phones or notebook computers) or wireless transmission devices are normally equipped with several lightweight antennas having different sizes. For example, planar inverted-F antennas (PIFA) or monopole antennas, having lightweight and excellent efficiency of transmission, can be easily disposed on the inner wall of portable electronic devices and therefore have been widely used in wireless transmission of portable electronic devices, notebook computers or wireless communication devices. In order to downsize the antenna device, the distance between the generally known dual-band antennas is reduced. However, such size reduction design will easily generate radiation interference if the distance between the antennas is too small. Therefore, how to provide an antenna device capable of eliminating the radiation interference between the antennas and at the same time preserving the features of lightweight and compactness has become a prominent task for the industries.

SUMMARY OF THE INVENTION

According to one embodiment of the present invention, a dual-band antenna is provided. The dual-band antenna includes a substrate, a first antenna assembly, an isolation metal sheet and a second antenna assembly. The substrate has a first side and a second side parallel to each other. The first antenna assembly is disposed on the first side of the substrate and includes a first planar inverted-F antenna and a second planar inverted-F antenna. The first planar inverted-F antenna includes a first radiation portion and a first ground portion. The first radiation portion is coupled to the first ground portion having a first feed end and a first ground end. The second planar inverted-F antenna includes a second radiation portion and a second ground portion. The second radiation portion is coupled to the second ground portion and the second ground portion has a second feed end and a second ground end. The first planar inverted-F antenna and the second planar inverted-F antenna are symmetric with each other and are disposed on the first side of the substrate. The isolation metal sheet is coupled between the first ground portion of the first planar inverted-F antenna and the second ground portion of the second planar inverted-F antenna. The second antenna assembly is disposed on the second side of the substrate and includes a third antenna and a fourth antenna. The third antenna includes a third radiation portion and a first feed connection portion. The first feed connection portion is coupled to the first ground portion of the first planar inverted-F antenna. The fourth antenna includes a fourth radiation portion and a second feed connection portion coupled to the second ground portion of the second planar inverted-F antenna. The third antenna and the fourth antenna are symmetric with each other and are disposed on the second side of the substrate. The first planar inverted-F antenna and the second planar inverted-F antenna are operated at a first frequency. The third antenna and the fourth antenna are operated at a second frequency. The first frequency is higher than the second frequency.

The above and other aspects of the invention will become better understood with regard to the following detailed description of the preferred but non-limiting embodiment(s). The following description is made with reference to the accompanying drawings.

DETAILED DESCRIPTION OF THE INVENTION

Figure 1:
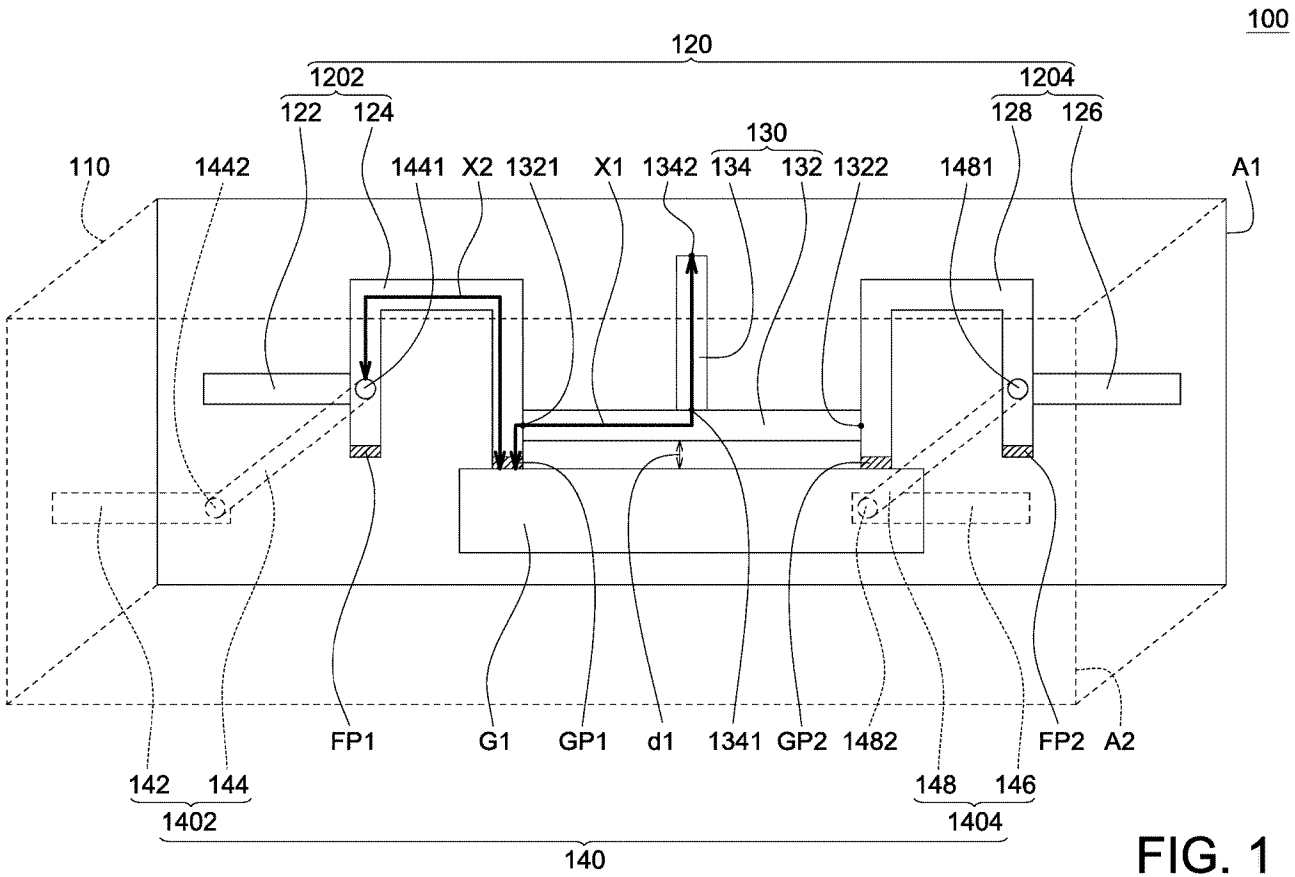
FIG. 1 is a schematic diagram of a dual-band antenna 100 according to an embodiment of the present disclosure.

FIG. 1 is a schematic diagram of a according to an embodiment of the present disclosure dual-band antenna 100. As indicated in FIG. 1, the dual-band antenna 100 includes a substrate 110, a first antenna assembly 120, an isolation metal sheet 130 and a second antenna assembly 140. The substrate 110 has a first side A1 and a second side A2 parallel to each other. The first antenna assembly 120 is disposed on the first side A1 of the substrate 110 and includes a first planar inverted-F antenna 1202 and a second planar inverted-F antenna 1204. The first planar inverted-F antenna 1202 includes a first radiation portion 122 and a first ground portion 124. The first radiation portion 122 is coupled to the first ground portion 124. The first ground portion 124 has a first feed end FP1 and a first ground end GP1. The second planar inverted-F antenna 1204 includes a second radiation portion 126 and a second ground portion 128. The second radiation portion 126 is coupled to the second ground portion 128. The second ground portion 128 has a second feed end FP2 and a second ground end GP2. The first ground end GP1 and the second ground end GP2 are coupled to a ground plane G1. The first planar inverted-F antenna 1202 and the second planar inverted-F antenna 1204 are symmetric with each other and are disposed on the first side A1 of the substrate 110.

The isolation metal sheet 130 is coupled between the first ground portion 124 of the first planar inverted-F antenna 1202 and the second ground portion 128 of the second planar inverted-F antenna 1204. The second antenna assembly 140 is disposed on the second side A2 of the substrate 110. The second antenna assembly 140 includes a third antenna 1402 and a fourth antenna 1404. The third antenna 1402 includes a third radiation portion 142 and a first feed connection portion 144 coupled to the first ground portion 124 of the first planar inverted-F antenna 1202. The fourth antenna 1404 includes a fourth radiation portion 146 and a second feed connection portion 148 coupled to the second ground portion 128 of the second planar inverted-F antenna 1204.

In the present embodiment, the first feed connection portion 146 and the second feed connection portion 148 both can be implemented by a via, for example. The third antenna 1402 and the fourth antenna 1404 are symmetric with each other and are disposed on the second side A2 of the substrate 110. The first planar inverted-F antenna 1202 and the second planar inverted-F antenna 1204 are operated at a first frequency. The third antenna 1402 and the fourth antenna 1404 are operated at a second frequency. The first frequency is higher than the second frequency.

For example, the first frequency is in the frequency band of 5 GH, and the second frequency is in the frequency band of 2.4 GHz. The isolation metal sheet 130 is used for isolating the radiation between the first planar inverted-F antenna 1202 and a second planar inverted-F antenna 1204. That is, the isolation metal sheet 130 is used for adjusting the matching or isolation effect of high-frequency portion.

In details, in the present embodiment, the isolation metal sheet can be implemented by a T-shaped structure, for example. The isolation metal sheet 130 includes an isolation connection portion 132 and an isolation extension portion 134. The isolation connection portion 132 has a first end 1321 and a second end 1322 which are coupled to the first ground portion 124 and the second ground portion 128 respectively. The isolation extension portion 134 has a first end 1341 and a second end 1342. The first end 1341 of the isolation extension portion is coupled to the middle point between the first end 1321 and the second end 1322 of the isolation connection portion 132. The isolation extension portion 134 and the isolation connection portion 132 are perpendicular to each other. The isolation connection portion 132 and the ground plane G1 are parallel to each other and are separated by a distance d1. Exemplarily, the distance dl is not larger than 2 millimeters (mm) or one tenth of the corresponding wavelength of the first frequency.

In the present embodiment, the matching or isolation effect of high-frequency portion antennas (that is, the first planar inverted-F antenna 1202 and the second planar inverted-F antenna 1204) can be adjusted by adjusting the size of the isolation connection portion 132 and the isolation extension portion 134. For example, the distance from the first ground end GP1 to the second end 1342 of the isolation extension portion 134 through the first end 1321 of the isolation connection portion 132 and the first end 1341 of the isolation extension portion 134 (indicated by X1 of FIG. 1) is equal to a quarter of the corresponding wavelength of the first frequency (5 GHz). Since the first planar inverted-F antenna 1202 and the second planar inverted-F antenna 1204 are symmetric with each other, the distance from the second ground end GP2 to the second end 1342 of the isolation extension portion 134 through the second end 1322 of the isolation connection portion 132 and the first end 1341 of the isolation extension portion 134 will also be equal to a quarter of the corresponding wavelength of the first frequency (5 GHz). Thus, the present disclosure can further adjust the matching or isolation effect of high-frequency portions by adjusting the size of the isolation connection portion 132 and the isolation extension portion 134 according to the antenna frequency of high-frequency portions to isolate the radiation between the first planar inverted-F antenna 1202 and a second planar inverted-F antenna 1204.

On the other hand, the first ground portion 124 and the second ground portion 128 respectively are used for isolating the radiation between the third antenna 1302 and the fourth antenna 1304. That is, the first ground portion 124 and the second ground portion 128 are used for adjusting the matching or isolation effect of low-frequency portions.

In details, the first feed connection portion 144 has a first connection end 1441 and a second connection end 1442. The first connection end 1441 is coupled to the first ground portion 124. The second connection end 1442 is coupled to the third radiation portion 142. The second feed connection portion 148 has a first connection end 1481 and a second connection end 1482 which are coupled to the second ground portion 128 and the fourth radiation portion 146 respectively.

In an embodiment, the matching or isolation effect of low-frequency portion antennas (that is, the third antenna 1402 and the fourth antenna 1404) can be adjusted by adjusting the size of the first ground portion 124 and the second ground portion 128. For example, the distance from the first connection end 1441 of the first feed connection portion 144 to the first ground end GP1 along the first ground portion 124 (indicated by X2 of FIG. 1) is a quarter or one eighth of the corresponding wavelength of the second frequency. Since the third antenna 1402 and the fourth antenna 1404 are symmetric with each other, the distance from the first connection end 1481 of the second feed connection portion 148 to the second ground end GP2 along the second ground portion 128 is also a quarter or one eighth of the corresponding wavelength of the second frequency. Thus, the present disclosure can adjust the matching or isolation effect of low-frequency portions by adjusting the size of the first ground portion 124 and the second ground portion 128 according to the antenna frequency of low-frequency portions to isolate the radiation between the third antenna 1402 and the fourth antenna 1404.

Figure 2:
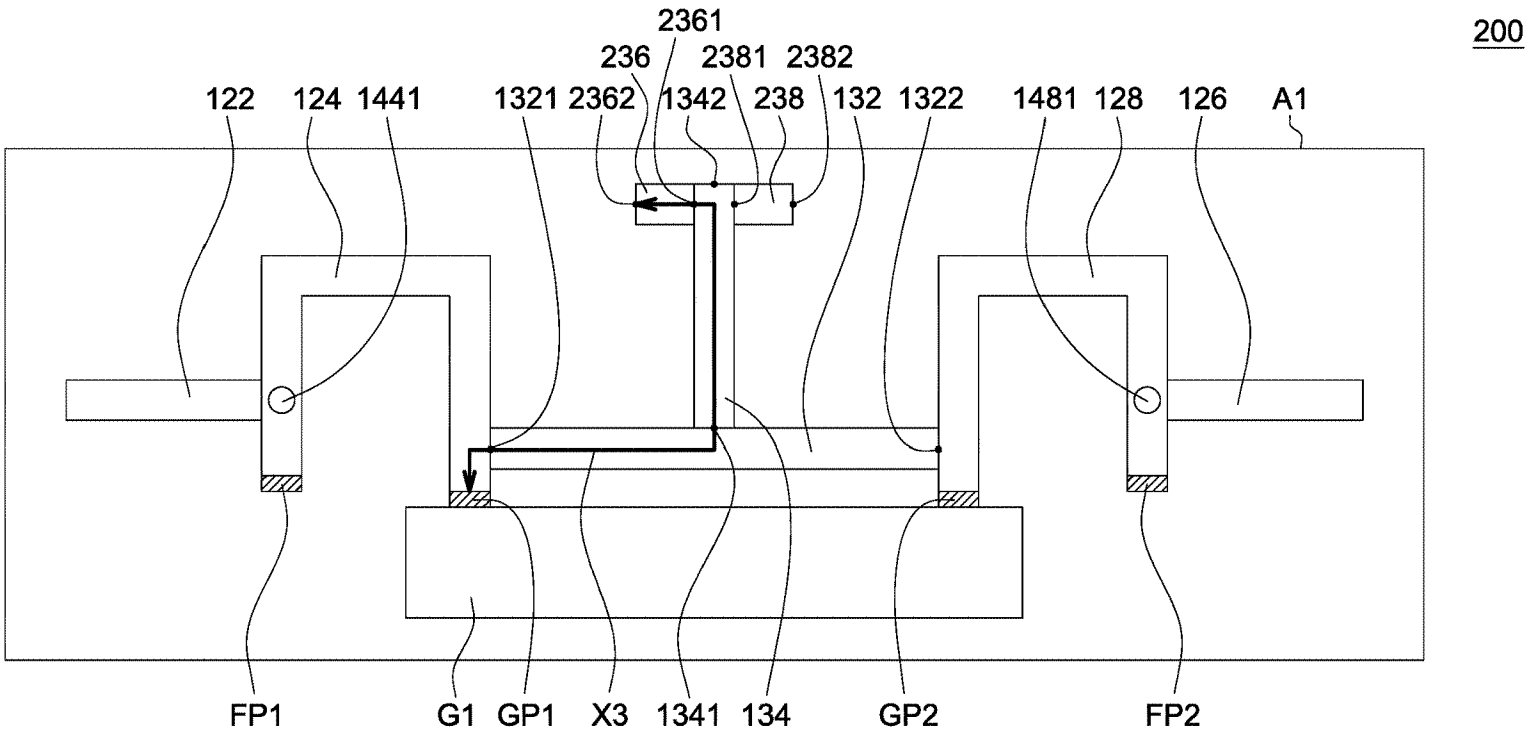
FIG. 2 is a schematic diagram of a dual-band antenna 200 according to another embodiment of the present disclosure.

The present disclosure does not restrict the shape of the isolation metal sheet 130. Referring to FIG. 2, a schematic diagram of a according to another embodiment of the present disclosure dual-band antenna 200 is shown. For the convenience of description, the second antenna assembly 140 disposed on the second side A2 of the substrate 110 is not illustrated in FIG. 2. The dual-band antenna 200 of FIG. 2 is different from the dual-band antenna 100 of FIG. 1 in that the isolation metal sheet of the dual-band antenna 200 is an H-shaped structure. The isolation metal sheet 130 further includes a first branch 236 and a second branch 238 symmetric with each other. The first branch 236 has a first end 2361 and a second end 2362. The first end 2361 of the first branch 236 is coupled to the second end 1342 of the isolation extension portion 134. The second branch 238 has a first end 2381 and a second end 2382. The first end 2381 of the second branch 238 is coupled to the second end 1342 of the isolation extension portion 134. The distance from the first ground end GP1 to the second end 2362 of the first branch 236 through the first end 1321 of the isolation connection portion 132, the first end 1341 and the second end 1342 of the isolation extension portion 134 is equal to a quarter of the corresponding wavelength of the first frequency. Likewise, the distance from the second ground end GP2 to the second end 2382 of the second branch 238 through the second end 1322 of the isolation connection portion 132 and the first end 1341 and and the second end 1342 of the isolation extension portion 134 is equal to a quarter of the corresponding wavelength of the first frequency.

Figure 3:
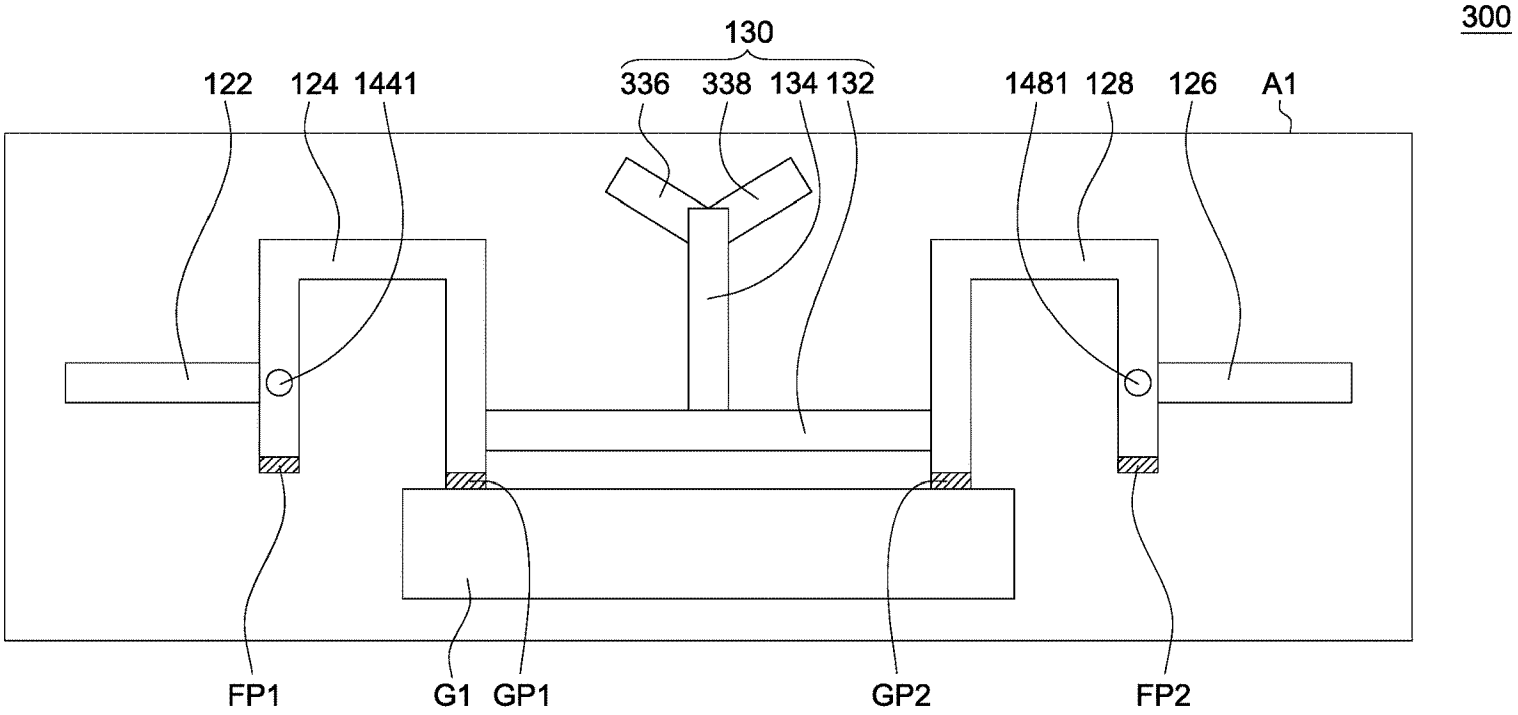
FIG. 3 is a schematic diagram of a dual-band antenna 300 according to another embodiment of the present disclosure.
Figure 4:
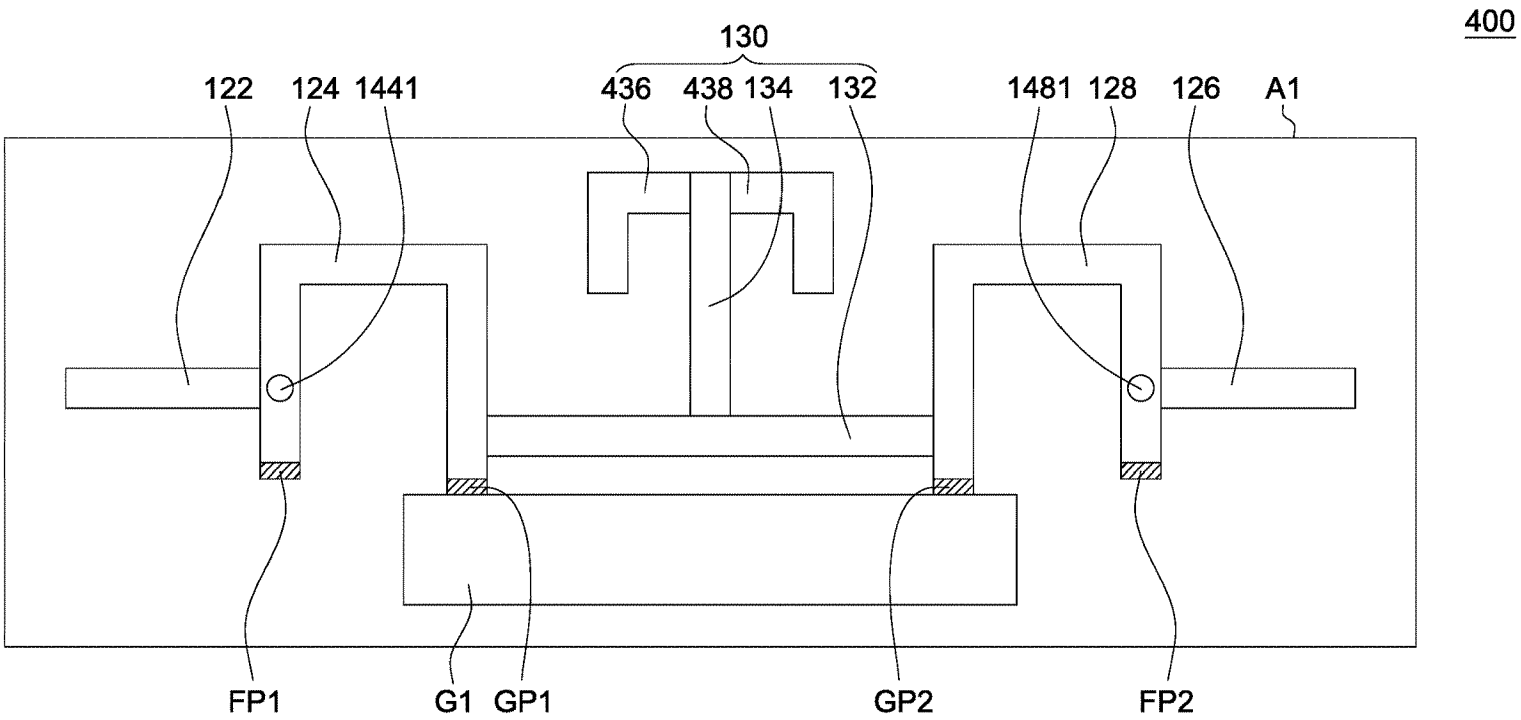
FIG. 4 is a schematic diagram of a dual-band antenna 400 according to another embodiment of the present disclosure.

Also, as indicated in FIG. 3, the dual-band antenna 300 of FIG. 3 is different from the dual-band antenna 100 of FIG. 1 in that the first branch 336 and the second branch 338 of the isolation metal sheet 130 form a symmetric V-shaped structure. Also, as indicated in FIG. 4, the dual-band antenna 400 of FIG. 4 is different from the dual-band antenna 100 of FIG. 1 in that the isolation metal sheet 130 includes a first branch 436 and a second branch 438 both having a bend. Thus, the present disclosure does not restrict the shape of the isolation metal sheet 130, and the shape or size of the isolation metal sheet 130 can be adjusted according to actual needs to collaborate with the matching or isolation effect of the first planar inverted-F antenna 1202 and the second planar inverted-F antenna 1204.

Figure 5:
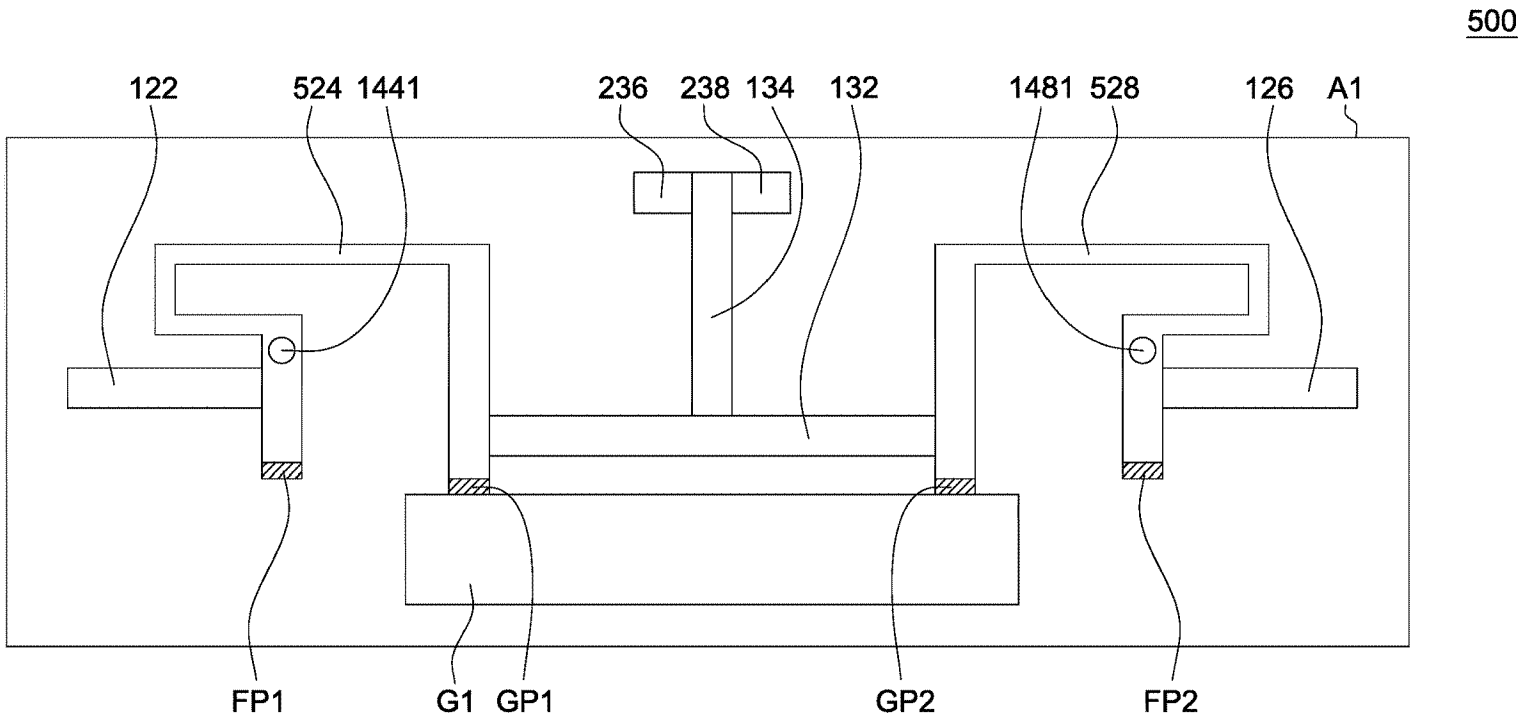
FIG. 5 is a schematic diagram of a dual-band antenna 500 according to another embodiment of the present disclosure.
Figure 6:
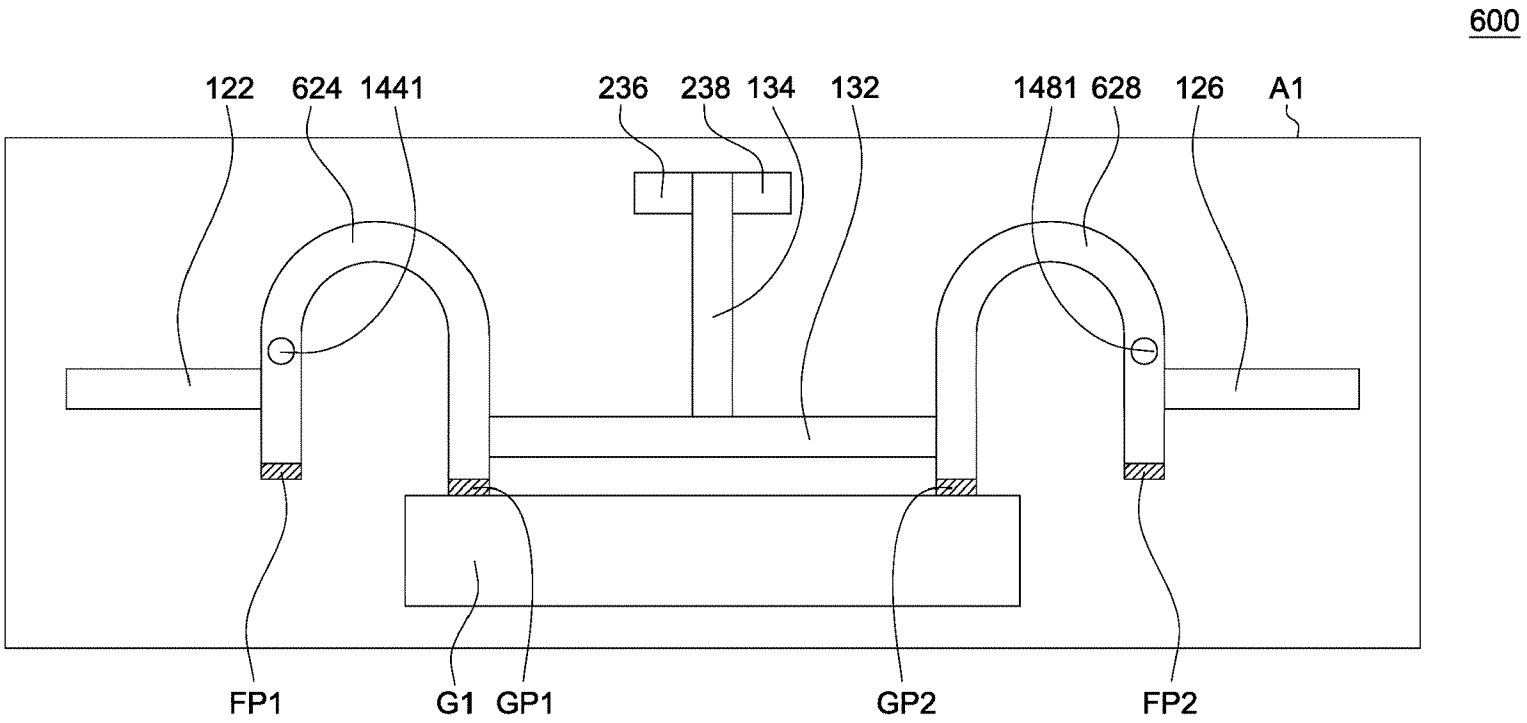
FIG. 6 is a schematic diagram of a dual-band antenna 600 according to another embodiment of the present disclosure.
Figure 7:
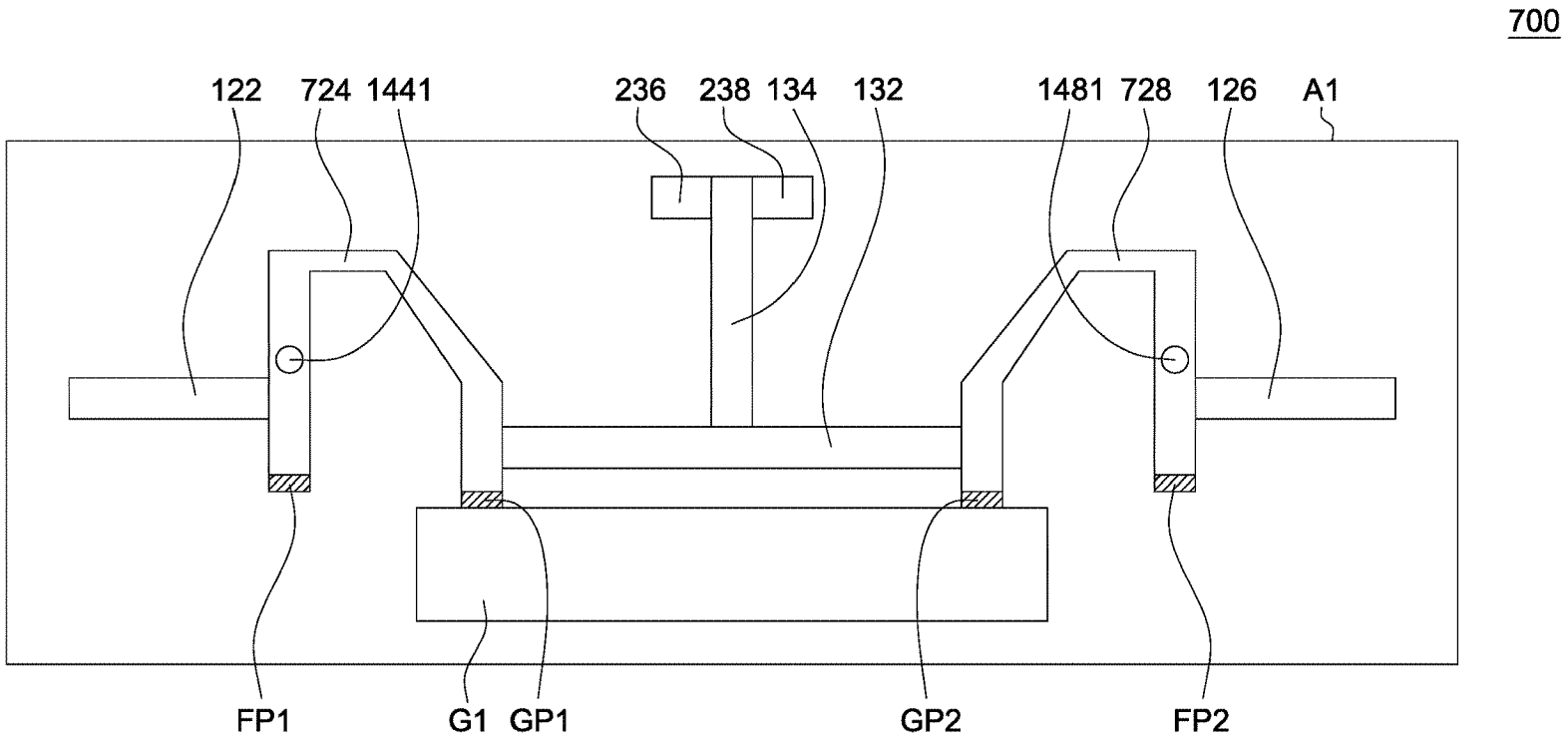
FIG. 7 is a schematic diagram of a dual-band antenna 700 according to another embodiment of the present disclosure.
Figure 8:
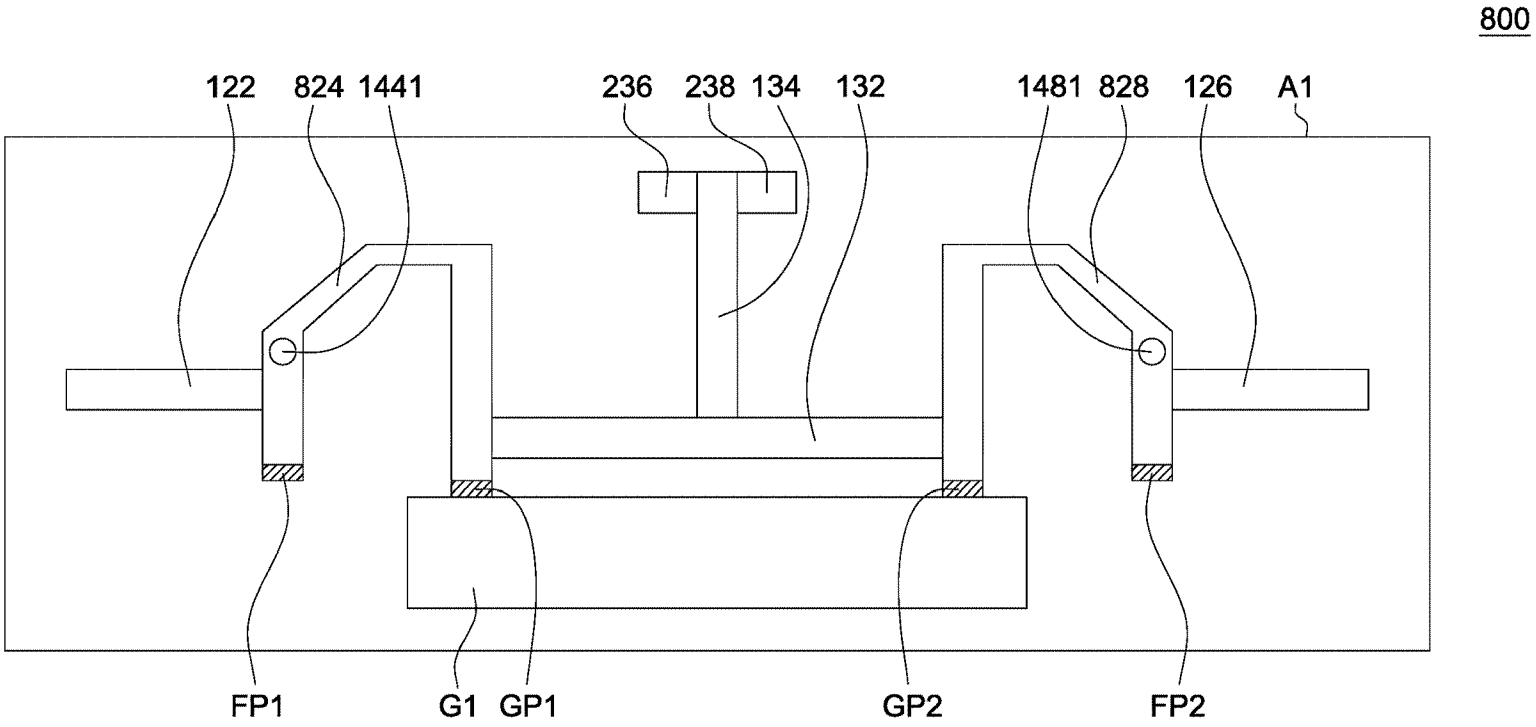
FIG. 8 is a schematic diagram of a dual-band antenna 800 according to another embodiment of the present disclosure.
Figure 9:
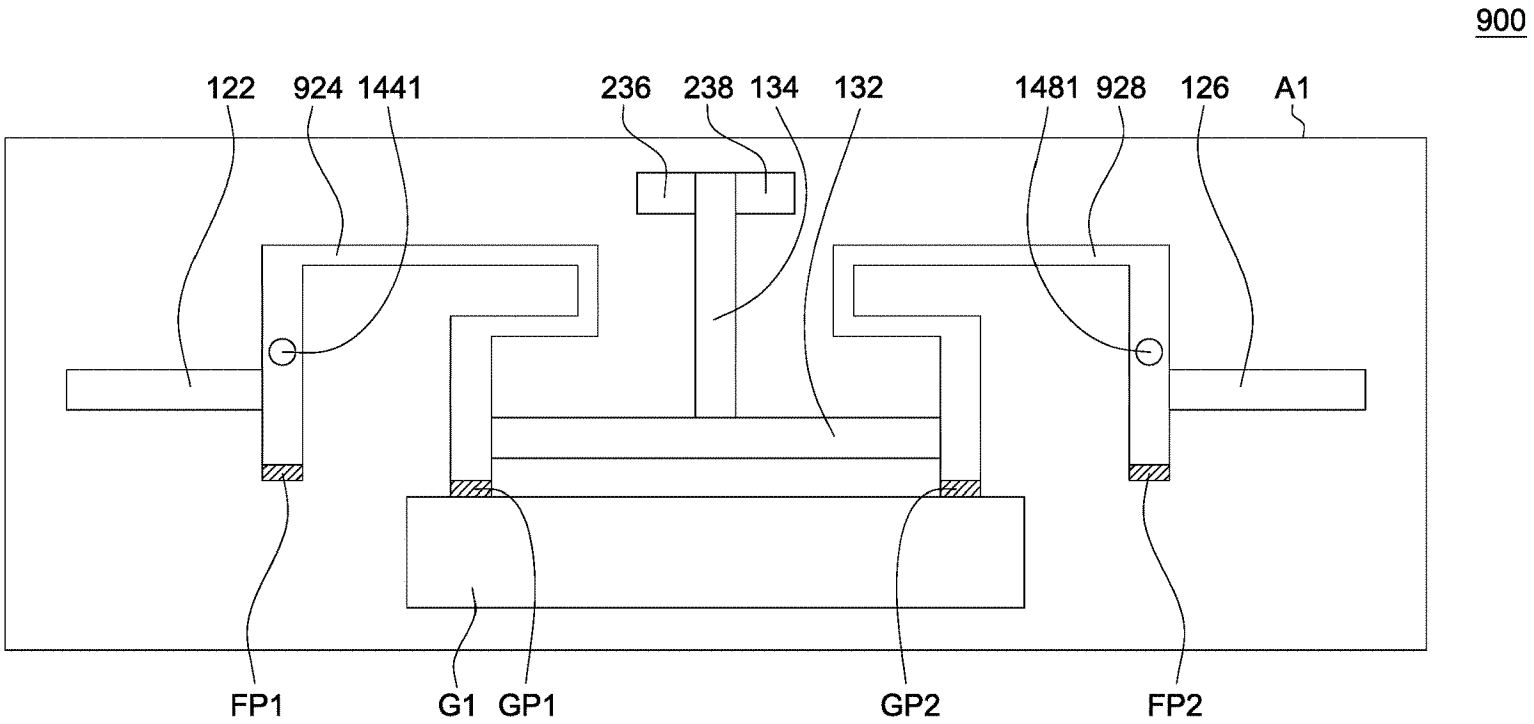
FIG. 9 is a schematic diagram of a dual-band antenna 900 according to another embodiment of the present disclosure.
Figure 10:
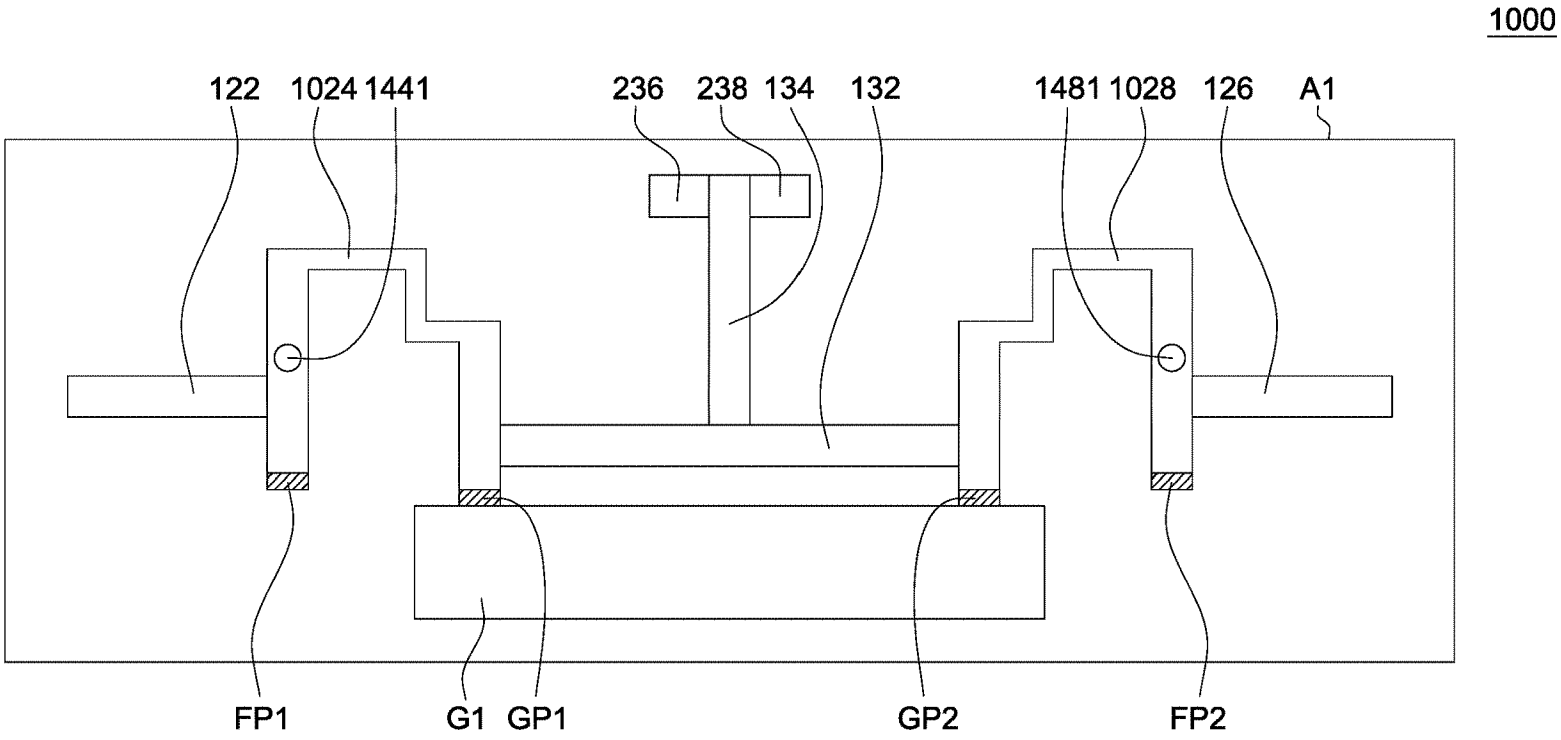
FIG. 10 is a schematic diagram of a dual-band antenna 1000 according to another embodiment of the present disclosure.
Figure 11:
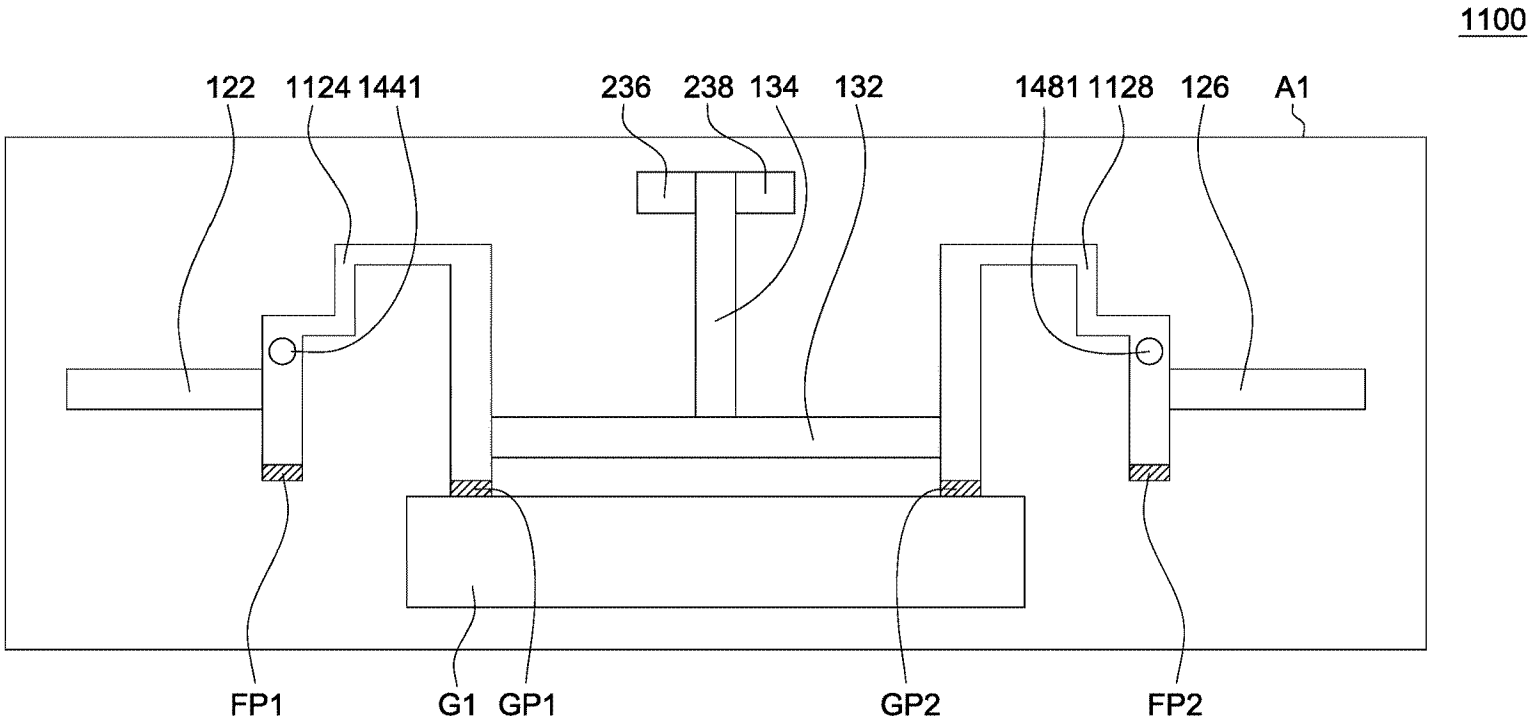
FIG. 11 is a schematic diagram of a dual-band antenna 1100 according to another embodiment of the present disclosure.

Likewise, the present disclosure does not restrict the structure or shape of the first antenna assembly 120. As indicated in FIG. 5, the dual-band antenna 500 of FIG. 5 is different from the dual-band antenna 100 of FIG. 1 in that the first ground portion 524 further includes a leftward bend, and the second ground portion 528 further includes a rightward bend. Also, as indicated in FIG. 6, the dual-band antenna 600 of FIG. 6 is different from the dual-band antenna 100 of FIG. 1 in that the first ground portion 624 and the second ground portion 628 form an arced and inverted U-shaped structure.

Refer to FIGS. 7~11. The dual-band antennas 700, 800, 900, 1000 and 1100 of FIG. 7~11 are different from the dual-band antenna 100 of FIG. 1 in that the structures of the first ground portions 724, 824, 924, 1024 and 1124 and the second ground portions 728, 828, 928, 1028 and 1128 are different. Although it is not illustrated in the diagrams, the present disclosure does not restrict the shape or structure of the first radiation portion 122. Thus, the structure or shape of the first antenna assembly 120 can be adjusted according to actual needs.

Likewise, although it is not illustrated in the diagrams, the present disclosure does not restrict the structure or shape of the second antenna assembly 140. The second antenna assembly 140 can be implemented by a single dipole antenna, a planar inverted-F antenna, a 3D antenna or other types of antennas. The second antenna assembly is disposed on the second side A2 of the substrate 110 and is coupled to the first ground portion 124 of the first planar inverted-F antenna 1202 and the second ground portion 128 of the second planar inverted-F antenna 1204 through the first feed connection portion 144 and the second feed connection portion 148 respectively.

Moreover, the position at which the first feed connection portion 144 is coupled to the first ground portion 124 of the first planar inverted-F antenna 1202 is not restricted. That is, the third antenna 1402 can be coupled through a via which can be located at any position of the first ground portion 124. Likewise, the fourth antenna 1404 can be coupled through a via which can be located at any position of the second ground portion 128.

To summarize, the dual-band antenna of the present disclosure use an isolation metal sheet to isolate the radiation between the first planar inverted-F antenna and a second planar inverted-F antenna such that the matching of high-frequency portion can be adjusted and high isolation effect can be achieved. The dual-band antenna further uses the first ground portion and the second ground portion to isolate the radiation between the third antenna and the fourth antenna such that the matching of low-frequency portions can be adjusted and high isolation effect can be achieved. Moreover, antenna designer can easily adjust the operating frequency of the antenna by changing the length or shape of the isolation metal sheet and/or by changing the length or shape of the radiation portion and/or the ground portion. Besides, the dual-band antenna of the present disclosure advantageously possesses the features of simple structure and lightweight, and therefore can be integrated with various types of electronic communication products according to actual needs.

While the invention has been described by way of example and in terms of the preferred embodiment (s), it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. A dual-band antenna, comprising:

a substrate having parallel to a first side and a second side each other;

a first antenna assembly disposed on the first side of the substrate and comprising:

a first planar inverted-F antenna comprising a first radiation portion and a first ground portion, wherein the first radiation portion is coupled to the first ground portion and the first ground portion has a first feed end and a first ground end; and a second planar inverted-F antenna comprising a second radiation portion and a second ground portion, wherein the second radiation portion is coupled to the second ground portion and the second ground portion has a second feed end and a second ground end;

wherein the first planar inverted-F antenna and the second planar inverted-F antenna are symmetric with each other and are disposed on the first side of the substrate;

an isolation metal sheet coupled between the first ground portion of the first planar inverted-F antenna and the second ground portion of the second planar inverted-F antenna; and a second antenna assembly disposed on the second side of the substrate and comprising:

a third antenna comprising a third radiation portion and a first feed connection portion coupled to the first ground portion of the first planar inverted-F antenna; and a fourth antenna comprising a fourth radiation portion and a second feed connection portion coupled to the second ground portion of the second planar inverted-F antenna;

wherein the third antenna and the fourth antenna are symmetric with each other and are disposed on the second side of the substrate;

wherein the first planar inverted-F antenna and the second planar inverted-F antenna are operated at a first frequency, the third antenna and the fourth antenna are operated at a second frequency, and the first frequency is higher than the second frequency.

2. The dual-band antenna according to claim 1, wherein the isolation metal sheet comprises:

an isolation connection portion having a first end and a second end, the first end and the second end being coupled to the first ground portion and the second ground portion respectively; and an isolation extension portion having a third end and a fourth end, wherein the third end is coupled to the middle point between the first end and the second end of the isolation connection portion, and the isolation extension portion and the isolation connection portion are perpendicular to each other.

3. The dual-band antenna according to claim 2, wherein the distance from the first ground end to the fourth end of the isolation extension portion through the first end of the isolation connection portion and the third end of the isolation extension portion is equal to a quarter of the corresponding wavelength of the first frequency, and the distance from the second ground end to the fourth end of the isolation extension portion through the second end of the isolation connection portion and the third end of the isolation extension portion is equal to a quarter of the corresponding wavelength of the first frequency.

4. The dual-band antenna according to claim 2, wherein the isolation metal sheet further comprises:

a first branch having a fifth end and a sixth end, wherein the fifth end is coupled to the four ends of the isolation extension portion; and a second branch having a seventh end and an eighth end, wherein the seventh end is coupled to the four ends of the isolation extension portion;

wherein the first branch and the second branch are symmetric with each other, the distance from the first ground end to the sixth end of the first branch through the first end of the isolation connection portion and the third end and the fourth end of the isolation extension portion is equal to a quarter of the corresponding wavelength of the first frequency, and the distance from the second ground end to the eighth end of the second branch through the second end of the isolation connection portion and the third end and the fourth end of the isolation extension portion is equal to a quarter of the corresponding wavelength of the first frequency.

5. The dual-band antenna according to claim 2, wherein the first ground end and the second ground end are coupled to a ground plane, and the isolation connection portion and the ground plane are parallel to each other and are separated by a distance.

6. The dual-band antenna according to claim 5, wherein the distance is smaller or equal to 2 millimeters (mm).

7. The dual-band antenna according to claim 1, wherein the first feed connection portion has a first connection end and a second connection end, the first connection end is coupled to the first ground portion, the second connection end is coupled to the third radiation portion, the second feed connection portion has a third connection end and a fourth connection end, the third connection end is coupled to the second ground portion, the fourth connection end is coupled to the fourth radiation portion, the distance from the first connection end to the first ground end along the first ground portion is a quarter or one eighth of the corresponding wavelength of the second frequency, and the distance from the third connection end to the second ground end along the second ground portion is equal to a quarter or one eighth of the corresponding wavelength of the second frequency.

8. The dual-band antenna according to claim 1, wherein the first feed connection portion and the second feed connection portion both are a via.

* * * * *